US009315908B2

(12) United States Patent
Idutsu et al.

(10) Patent No.: US 9,315,908 B2
(45) Date of Patent: Apr. 19, 2016

(54) ELECTROLYTIC CELL FOR PRODUCING CHLORINE—SODIUM HYDROXIDE AND METHOD OF PRODUCING CHLORINE—SODIUM HYDROXIDE

(75) Inventors: Tomonori Idutsu, Kakogawa (JP); Koji Saiki, Toyonaka (JP); Yukinori Iguchi, Okayama (JP); Kiyohito Asaumi, Okayama (JP)

(73) Assignees: CHLORINE ENGINEERS CORP. (JP); KANEKA CORPORATION (JP); TOAGOSEI CO., LTD. (JP)

( * ) Notice: Subject to any disclaimer, the term of this patent is extended or adjusted under 35 U.S.C. 154(b) by 0 days.

(21) Appl. No.: 13/807,790

(22) PCT Filed: Oct. 1, 2010

(86) PCT No.: PCT/JP2010/067240

§ 371 (c)(1),
(2), (4) Date: Feb. 25, 2013

(87) PCT Pub. No.: WO2012/008060

PCT Pub. Date: Jan. 19, 2012

(65) Prior Publication Data

US 2013/0153433 A1 Jun. 20, 2013

(30) Foreign Application Priority Data

Jul. 13, 2010 (JP) ..... 2010-158637

(51) Int. Cl.
*C25B 1/16* (2006.01)
*C25B 1/26* (2006.01)
(Continued)

(52) U.S. Cl.
CPC ... *C25B 1/16* (2013.01); *C25B 1/26* (2013.01); *C25B 1/34* (2013.01); *C25B 1/46* (2013.01); *C25B 9/08* (2013.01); *C25B 13/04* (2013.01); *C25B 13/08* (2013.01)

(58) Field of Classification Search
CPC ..... C25B 1/16; C25B 1/26; C25B 1/34; C25B 1/46; B01D 2325/36
USPC ..... 205/508–537, 556
See application file for complete search history.

(56) References Cited

U.S. PATENT DOCUMENTS 4,568,442 A 2/1986 Goldsmith
5,389,458 A * 2/1995 Weiss et al. ..... 429/90
(Continued)

FOREIGN PATENT DOCUMENTS

EP 0 686 709 A2 12/1995
EP 1 398 397 A1 3/2004
(Continued)

OTHER PUBLICATIONS

Nagarale et al, "Development of Urethane Acrylate Composite Ion-exchange Membranes and Their Electrochemical Characterization," Journal of Colloid and Interface Science, vol. 270, # 2, Feb. 2004, pp. 446-454.*
(Continued)

*Primary Examiner* — Keith Hendricks
*Assistant Examiner* — Salil Jain
(74) *Attorney, Agent, or Firm* — Ostrolenk Faber LLP

(57) ABSTRACT

There is provided a method of production of chlorine.sodium hydroxide capable of being operated stably and economically by preventing calcium from being deposited in an ion exchange membrane. The liquid retention layer 3 having a liquid retention amount per unit volume of the liquid retention layer of 0.10 g-$H_2O/cm^3$ or more and 0.80 g-$H_2O/cm^3$ or less is put between the ion exchange membrane 12 and the gas diffusion electrode 16. Calcium ions transferred through the ion exchange membrane 12 easily diffuse, thereby making it possible to suppress increase in an electrolytic voltage and drop in current efficiency generated by deposition of the calcium ions inside the ion exchange membrane 12.

5 Claims, 4 Drawing Sheets

(51) Int. Cl.

| | |
|---|---|
| ***C25B 1/46*** | (2006.01) |
| ***C25B 9/08*** | (2006.01) |
| ***C25B 13/08*** | (2006.01) |
| ***C25B 1/34*** | (2006.01) |
| ***C25B 13/04*** | (2006.01) |

(56) References Cited

U.S. PATENT DOCUMENTS

| | | | | |
|---|---|---|---|---|
| 6,117,286 | A * | 9/2000 | Shimamune et al. | 204/252 |
| 6,368,473 | B1 * | 4/2002 | Furuya et al. | 204/263 |
| 7,972,484 | B2 * | 7/2011 | Urgeghe et al. | 204/263 |
| 2002/0110726 | A1 | 8/2002 | Busse et al. | |
| 2005/0000798 | A1 * | 1/2005 | Faita et al. | 204/242 |
| 2006/0205301 | A1 | 9/2006 | Klare et al. | |
| 2007/0095676 | A1 | 5/2007 | Yamada et al. | |
| 2009/0071820 | A1 * | 3/2009 | Saiki et al. | 204/252 |
| 2009/0306233 | A1 | 12/2009 | Umemura et al. | |

FOREIGN PATENT DOCUMENTS

| | | |
|---|---|---|
| JP | 55-069277 | 5/1980 |
| JP | 11-124698 | 5/1999 |
| JP | 3553775 | 8/2004 |
| JP | 2006-322018 | 11/2006 |
| JP | 2010-138495 | 6/2010 |
| WO | WO 2008/006909 A2 | 1/2008 |

OTHER PUBLICATIONS

International Search Report mailed Dec. 7, 2010 in corresponding PCT International Application No. PCT/JP2010/067240.

Extended European Search Report dated Mar. 27, 2014 issued in corresponding European Patent Application No. 10 854 742.3.

R. K. Nagarale, et al., "Development of Urethane Acrylate Composite Ion-Exchange Membranes and Their Electrochemical Characterization," Journal of Colloid and Interface Science, vol. 270, No. 2, Feb. 15, 2004, pp. 446-454.

Examination Report dated Nov. 20, 2015 in corresponding European Patent Application No. 10 854 742.3 (5 pages).

T. Takamatsu, et al., "Densities and Expansion Coefficients of Nafion Polymers," Journal of Applied Polymer Science, vol. 24, No. 11, pp. 2221-2235 (Jan. 1, 1979).

* cited by examiner

ELECTROLYTIC CELL FOR PRODUCING CHLORINE—SODIUM HYDROXIDE AND METHOD OF PRODUCING CHLORINE—SODIUM HYDROXIDE

CROSS-REFERENCE TO RELATED APPLICATIONS

The present application is a 35 U.S.C. §§371 national phase conversion of PCT/JP2010/067240, filed Oct. 1, 2010, which claims priority of Japanese Patent Application No. 2010-158637, filed Jul. 13, 2010, the contents of which are incorporated herein by reference. The PCT International Application was published in the Japanese language.

TECHNICAL FIELD

This invention relates to an electrolytic cell for producing chlorine.sodium hydroxide and to a method of producing chlorine.sodium hydroxide, and more specifically to an electrolytic cell for preventing efficiently calcium from being deposited when producing chlorine.sodium hydroxide by the use of gas diffusion electrode.

BACKGROUND ART

Electrolysis of brine has been playing an important role as a material industry. However, energy consumption required for electrolysis is high. In Japan where an energy cost is high, therefore, saving energy used for electrolysis has been an important problem.

An ion exchange method which has been currently a mainstream obtains aqueous solution of sodium hydroxide, chlorine and hydrogen by electrolysis of brine (reference should be made to the equation (1) described below). While the theoretical decomposition voltage by the ion exchange method is about 2.19 volts, the operation is practically conducted at an actually-required voltage (hereinafter referred to as "actual voltage") of about 3 volts, because of the ohmic potential loss, the overvoltage of an electrode, etc.:

$$2NaCl+2H_2O \rightarrow Cl_2+2NaOH+H_2 \quad (1)$$

By contrast, in order to attempt a significant energy saving, a combination method has been investigated in which an ion exchange method is combined with a method using a gas diffusion electrode as a cathode to reduce oxygen (reference should be made to the equation (2) described below) and such a combination-method is (hereinafter referred to as "oxygen cathode method").

$$2NaCl+\tfrac{1}{2}O_2+H_2O \rightarrow Cl_2+2NaOH \quad (2)$$

The oxygen cathode method can lower the theoretical decomposition voltage to 0.96 volts and can be operated at an actual voltage of about 2 volts, even including the other resistance components. While no hydrogen is generated, the energy saving of 30% or more can be expected.

As a method which is an improved oxygen cathode method, a method is disclosed in Patent Literatures 1 to 3, in which the gas diffusion electrode is in close contact with the ion exchange membrane, more specifically a method is disclosed therein in which a cathode chamber is configured as a cathode gas chamber. Since this method is composed of two chambers, that is, the anode chamber and the cathode chamber, it may be referred to as a two-chamber method, contrary to a three chamber method composed of the anode chamber, the cathode chamber and the gas chamber. In this method, the gas diffusion electrode is brought into contact with the ion exchange membrane, and an elastic material (cushion material) is packed into the cathode chamber so as to compress the gas diffusion electrode uniformly to the entire surface of the anode via the ion exchange membrane by using the repulsive force generated therein. Further, in order to hold and discharge the aqueous solution of sodium hydroxide more securely, there is a case where a hydrophilic liquid-penetrating material is put between the ion exchange membrane and the gas diffusion electrode. This two-chamber method is an improved method in that the voltage or electricity consumption can be reduced, because the inter-electrode distance is minimized compared with the conventional three-chamber method.

According to the two-chamber method, it is possible that the aqueous solution of sodium hydroxide can be held by the liquid-penetrating material (that is, a liquid retention layer described in paragraph [0025] of Patent Literature 3) and electrolysis can be conducted stably by interposing the hydrophilic liquid-penetrating material between the ion exchange membrane and the gas diffusion electrode. There has been, however, a problem that a minute amount of calcium ion transferred to the cathode by water penetrating through the ion exchange membrane (hereinafter referred to as "penetrating-water") easily deposits on the surface of the cathode facing the ion exchange membrane, depending on the material or structure of the liquid-penetrating material of the method. A calcium ion originates from impurities remaining in brine. Such a phenomenon on the surface of the cathode facing the ion exchange membrane is not observed in a three-chamber method.

In the ion exchange membrane method, it is required that the concentration of calcium ion in the brine supplied into the anode chamber should be maintained in low concentration under the strict control of purification of the brine. As one of such methods of purification, a method for removing calcium ion, etc, has been known in which the purification by a chelate resin is added to a brine-purification process comprising a flocculation reactor, a setting tank, a sand filter and a micro filter. Even if, however, the purification by a chelate resin is carried out, it is hard to remove completely a calcium ion in the brine, and a calcium ion remains in the brine in approximately 10 ppb. Some of the remaining calcium ions move toward the cathode through the ion exchange membrane along with penetrating water, and reacts with the aqueous solution of sodium hydroxide of high concentration when they reach to the vicinity of the surface of the ion exchange membrane to produce calcium hydroxide which is deposited in the vicinity of the surface of the ion exchange membrane. In the case of electrolytic cell in which the hydrophilic liquid-penetrating material is put between the ion exchange membrane and the gas diffusion electrode, the flow of the aqueous solution of sodium hydroxide is decreased at the point with which the hydrophilic liquid-penetrating material is in contact; and the calcium ions moving through the ion exchange membrane hardly diffuse and are bonded with hydroxyl ions to be easily deposited on the surface of the ion exchange membrane.

CITATION LIST

Patent Literature

PLT1: Patent Publication (Toku-Kai-Hei) 11-124698
PLT2: U.S. Pat. No. 3,553,775
PLT3: Patent Publication (Toku-Kai) 2006-322018

SUMMARY OF INVENTION

Problems to be Solved by Invention

Such a problem as described above does not affect in such a short period of operation as about one month. Since, however, the ion exchange membrane is high expensive, a commercial electrolytic cell has been continuously operated for about five years until the renewal of the ion exchange membrane. In the meanwhile, the deposition of calcium is accumulated in the ion exchange membrane to cause the degradation of the ion exchange membrane, and therefore such an influence is made larger. Due to the degradation of the ion exchange membrane, it is necessary to shorten the cycle of the renewal of the ion exchange membrane, which increases the ratio of the purchase cost of the ion exchange membrane accounting in the total production costs. That is uneconomical. When the operation is carried out under the condition that the electrolytic voltage and current efficiency are left deteriorated, the costs of electric power increase uneconomically and there are possibilities in the worst case that the anode, etc. may be damaged due to the occurrence of blisters in the ion exchange membrane or breakage by drop in strength of the ion exchange membrane.

This invention provides an electrolytic cell for producing chlorine.sodium hydroxide and a method of producing chlorine.sodium hydroxide, which solve such afore-mentioned problems of the prior arts as the degradation of the membrane due to the deposition of calcium in the ion exchange membrane, and which are capable of being operated stably and economically.

Means for Solving the Problems

This invention is relating to an electrolytic cell, in which the electrolytic cell is divided into an anode chamber and a cathode chamber by an ion exchange membrane; an anode is installed in the anode chamber, a liquid retention layer and a gas diffusion electrode are installed in the cathode chamber; brine is supplied into the anode chamber and an oxygen-containing gas is supplied into the cathode chamber to perform electrolysis, characterized in that the liquid retention layer having a liquid retention amount per unit volume of the liquid retention layer of 0.10 g-$H_2O/cm^3$ or more and 0.80 g-$H_2O/cm^3$ or less is put between the ion exchange membrane and the gas diffusion electrode and a method of production of chlorine and sodium hydroxide.

Hereinafter, this invention will be described more in detail.

The electrolytic cell of this invention is used for the purpose of electrolysis of brine to produce sodium hydroxide and chlorine. In the two-chamber method in which the gas diffusion electrode is installed in contact with the ion exchange membrane, a cathode reaction: [$2H_2O+O_2+4e^- \rightarrow 4OH^-$] occurs on the surface of the cathode, the sodium hydroxide produced flows down through the hydrophilic liquid retention layer as a solution and extracted from the lower part of the cathode chamber. Since no aqueous solution is supplied into the cathode chamber like a conventional electrolytic cell of brine, the adjustment of the concentration by addition of water, etc. is difficult. Accordingly, the concentration of the aqueous solution of sodium hydroxide extracted from the cathode chamber is determined by penetrating water from the anode chamber.

When an ion exchange membrane generally used at present is used, the proper range of the concentration of brine at the anode chamber outlet is about 190~230 g-NaCl/L and the amount of the penetrating water is about 4.1~4.5 mol-$H_2O$/F. When the two-chamber method is operated under these conditions, the concentration of the aqueous solution of sodium hydroxide becomes 36.5~40.0% by weight. This is a drastically severe state of operation (concentration of sodium hydroxide), because the proper range of the concentration of aqueous solution of sodium hydroxide at the cathode chamber outlet of the generally-used ion exchange membrane is 30.0~34.0% by weight. It is, therefore, preferable that the concentration of the aqueous solution of sodium hydroxide is adjusted to from 33.0~35.0% by weight, by the use of an ion exchange membrane with the greatest amount of the penetrating water possible, and by increasing the amount of the penetrating water by diluting the concentration of brine at the anode chamber outlet to 150~190 g-NaCl/L.

The principal object of this invention is to provide an electrolytic cell and a method of production of chlorine and sodium hydroxide, in which the liquid retention layer having a liquid retention amount per unit volume of the liquid retention layer of 0.10 g-$H_2O/cm^3$ or more and 0.80 g-$H_2O/cm^3$ or less is put between the ion exchange membrane and the gas diffusion electrode, thereby diffusing easily calcium ions transferred through the ion exchange membrane, and making it possible to prevent calcium from being deposited in the ion exchange membrane. Thereby, a two-chamber method-type electrolytic cell of brine having the renewal cycle of ion exchange membrane equivalent to that of a three-chamber method-type electrolytic cell of brine at the present and a method of electrolysis are realized.

The liquid retention layer used in this invention is not particularly limited so long as it has a shape capable of holding liquid, specifically aqueous solution of sodium hydroxide, but may be usually preferable the shape of fabric in which fibers are woven. The liquid retention amount of the liquid retention layer can be adjusted by materials, manner of weaving fibers, density (number of fibers per inch), etc, of fabric.

The liquid retention amount of the liquid retention layer used in this invention is defined as B-A; herein, [A] is the weight obtained by a method in which the liquid retention layer is immersed in an aqueous solution of 34.5% by weight of sodium hydroxide for one day, washed by water to remove completely the aqueous solution of sodium hydroxide, and dried completely; [B] is the weight obtained by a method in which the afore-mentioned completely-dried liquid retention layer is immersed in pure water for one hour and taken out of the pure water. The liquid retention amount per unit volume is defined as a value obtained by dividing the liquid retention amount by the volume of the liquid retention layer used for the measurement of the liquid retention amount.

The liquid retention amount per unit volume of the liquid retention layer used in this invention is 0.10 g-$H_2O/cm^3$ or more and 0.80 g-$H_2O/cm^3$ or less. When the liquid retention amount is 0.10 g-$H_2O/cm^3$ or more and 0.80 g-$H_2O/cm^3$ or less, the diffusion of the aqueous solution of sodium hydroxide is accelerated and the prevention of the accumulation of calcium in the ion exchange membrane is made possible, and it is possible that the amount of accumulation of calcium in the ion exchange membrane is 550 $mg/m^2$ or less for 30-days operation. When the ion exchange membrane having such an amount of accumulation of calcium is continuously operated, the drop in the current efficiency after the elapse of 400 days can be decreased to 0.7% or less, and a highly efficient operation is made possible.

Preferably, the liquid retention amount is 0.15 g-$H_2O/cm^3$ or more and 0.61 g-$H_2O/cm^3$ or less. When the liquid retention amount is 0.15 g-$H_2O/cm^3$ or more and 0.61 g-$H_2O/cm^3$ or less, the diffusion of the aqueous solution of sodium hydroxide is accelerated and the prevention of the accumulation of calcium in the ion exchange membrane is made possible, and it is possible that the amount of accumulation of calcium in the ion exchange membrane is 200 $mg/m^2$ or less for 30-days operation. When the ion exchange membrane having such an amount of accumulation of calcium is continuously operated, the drop in the current efficiency after the elapse of 400 days can be decreased to 0.4% or less, and a more highly efficient operation is made possible.

More preferably, the liquid retention amount is 0.20 g-$H_2O/cm^3$ or more and 0.55 g-$H_2O/cm^3$ or less. When the liquid retention amount is 0.20 g-$H_2O/cm^3$ or more and 0.55 g-$H_2O/cm^3$ or less, the diffusion of the aqueous solution of sodium hydroxide is more accelerated and prevention of the accumulation of calcium in the ion exchange membrane is made possible, and it is possible that the amount of accumulation of calcium in the ion exchange membrane is 150 $mg/m^2$ or less for 30-days operation. When the ion exchange membrane having such an amount of accumulation of calcium is continuously operated, the drop in the current efficiency after the elapse of 400 days can be decreased to 0.3% or less, and a more highly efficient operation is made possible.

Most preferably, the liquid retention amount is 0.25 g-$H_2O/cm^3$ or more and 0.40 g-$H_2O/cm^3$ or less. When the liquid retention amount is 0.25 g-$H_2O/cm^3$ or more and 0.40 g-$H_2O/cm^3$ or less, the diffusion of the aqueous solution of sodium hydroxide is most accelerated and prevention of the accumulation of calcium in the ion exchange membrane is made possible, and it is possible that the amount of accumulation of calcium in the ion exchange membrane is 50 $mg/m^2$ or less for 30-days operation. When the ion exchange membrane having such an amount of accumulation of calcium is continuously operated, the drop in the current efficiency after the elapse of 400 days can be decreased to 0.3% or less, and a more highly efficient operation is made possible.

When the liquid retention amount is smaller than 0.10 g-$H_2O/cm^3$, the diffusion of the sodium hydroxide becomes small, and calcium ions easily accumulate. On the other hand, even if the liquid retention amount is larger than 0.80 g-$H_2O/cm^3$, the discharging rate of the aqueous solution of sodium hydroxide slows down and calcium ions easily accumulate. As a result, the drop in the current efficiency increases and the operation is extremely low efficient.

The thickness of the liquid retention layer is not particularly limited; but when the thickness of the liquid retention layer is thick, the solution resistance of the aqueous solution of sodium hydroxide contained in the liquid retention layer becomes larger. When the thickness of the liquid retention layer increases by 1 mm, the solution resistance increases by 15 mV. Therefore, in order to prevent the increase in the electric power used due to the increase in the electrolytic voltage, it is preferable to satisfy the afore-mentioned liquid retention amount and use a thin liquid retention layer.

Advantageous Effects of Invention

This invention is relating to an electrolytic cell in which; the electrolytic cell for conducting electrolysis is divided into an anode chamber and a cathode chamber by an ion exchange membrane; an anode is installed in the anode chamber; a liquid retention layer and a gas diffusion electrode are installed in the cathode chamber; brine is supplied into the anode chamber; and an oxygen-containing gas is supplied into the cathode chamber to conduct electrolysis, characterized in that the liquid retention layer having a liquid retention amount per unit volume of the liquid retention layer of 0.10 g-$H_2O/cm^3$ or more and 0.80 g-$H_2O/cm^3$ or less is put between the ion exchange membrane and the gas diffusion electrode, and relating to a method of production of chlorine and sodium hydroxide.

In a conventional electrolytic cell in which a hydrophilic liquid-penetrating material is interposed between an ion exchange membrane and a gas diffusion electrode, there have been problems that calcium ions transferred by penetrating water deposit easily on the ion exchange membrane. Contrary to this, according to this invention, by specifying the liquid retention amount of the liquid retention layer, calcium ions moved through the ion exchange membrane are made to diffuse easily, the occurrence of the degradation of the membrane due to the deposition of calcium on the ion exchange membrane is solved, and stable and economical operation of electrolysis is made possible.

DESCRIPTION OF EMBODIMENTS

It is preferable in this invention that the liquid retention layer interposed between the ion exchange membrane and the gas diffusion electrode has chemical resistance against sodium hydroxide and physical resistance. The chemical resistance may be defined as a material having resistance against high alkalinity; and the physical resistance may be defined as a material having a proper strength against the load applied to the electrolytic cell. A material of the liquid retention layer is exemplified by a carbon, zirconium oxide, or a ceramics of silicon carbide, etc., resins such as hydrophilic-treated PTFE (polytetrafluoroethylene), FEP (tetrafluoroethylene-propylene hexafluoride copolymer), etc. aramid resin (general term for aromatic polyamides), metals such as nickel, silver, etc. and alloys thereof, or stainless steel. Since the above-described material is interposed between the ion exchange membrane and the gas diffusion electrode, it is preferable that such a material has elasticity and ability of absorbing pressure by its deformation at the time of generation of uniformity of pressure.

Figure 1:
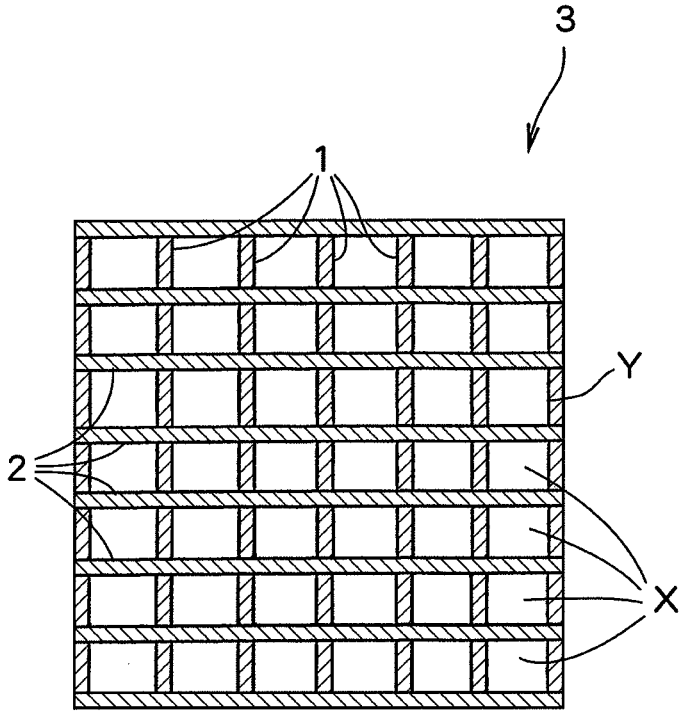
FIG. 1 is a front view showing a first example of a liquid retention layer usable in this invention.
Figure 2:
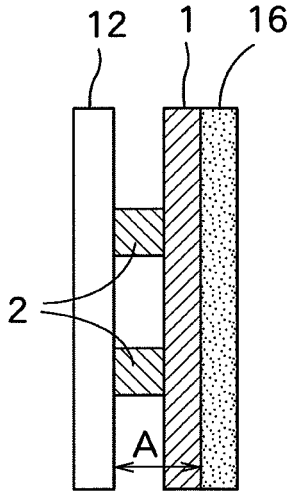
FIG. 2 is a longitudinal section of a liquid retention layer shown in FIG. 1.

The structures of the liquid retention layer are, for example, a mesh, a woven fabric, a nonwoven article, foam, a thin sheet, etc. Examples thereof are shown in FIGS. 1~5. FIGS. 1 and 2 show a first example of the liquid retention layer, in which plural longitudinal materials 1 and plural transversal materials 2 are crossed and bonded each other to form the liquid retention layer 3. In this example, the distance A in the direction of the depth of the liquid retention layer may be defined as "thickness-A" as shown in FIG. 2.

As described above for the liquid retention layer shown in FIGS. 1 and 2, the thickness-A is not specifically limited. It may be, however, preferable that the thickness-A satisfies the afore-mentioned liquid retention amount and a thin liquid retention layer is used. This is because that when the thickness of the liquid retention layer is thick, the solution resistance of the aqueous solution of the sodium hydroxide contained in the liquid retention layer becomes larger to increase the electrolytic voltage.

The liquid retention layer having such a structure as described above can be obtained as a usual mesh or simple plain weave. In a case of a mesh, etc. the liquid retention layer can be formed by enlarging a mesh size. In a case of knitting, etc. the liquid retention layer can be formed by adopting knitting which is not a plain fabric, for example, stockinet stitch, fleecy stitch, pearl stitch, rib stitch, chain stitch, dembigh (tricot) stitch, atlas stitch, cord stitch, etc.

Figure 3:
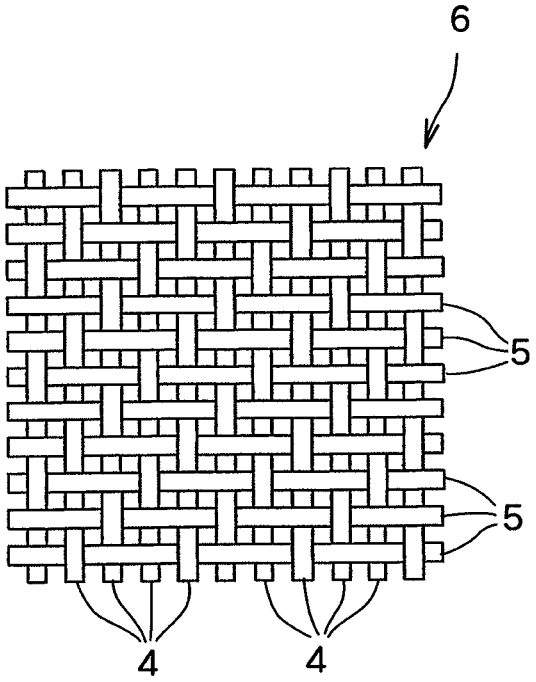
FIG. 3 is a front view showing a second example of a liquid retention layer usable in this invention.

The liquid retention layer used in this invention is not limited to a first example shown in FIGS. 1 and 2, but in a second example shown in FIG. 3 plural longitudinal materials 4 and plural transversal materials 5 are interwoven each other to form a mesh-like liquid retention layer 6.

Figure 4:
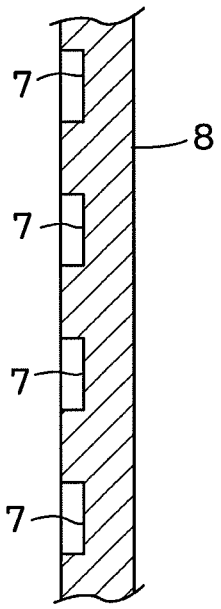
FIG. 4 is a longitudinal section of a third example of a liquid retention layer usable in this invention.

In a third example shown in FIG. 4, the liquid retention layer 8 is formed by forming a plurality of concavities 7 on one side of a thin plate.

Figure 5:
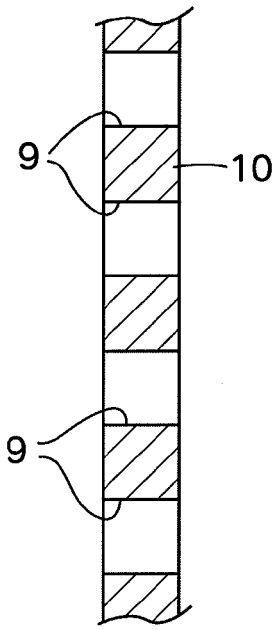
FIG. 5 is a longitudinal section of a fourth example of a liquid retention layer usable in this invention.

In a fourth example shown in FIG. 5, the liquid retention layer 10 is formed by making a plurality of penetrations 9 through the thin plate.

In order to install the liquid retention layer between an ion exchange membrane and a gas diffusion electrode, the liquid retention layer is interposed between the ion exchange membrane and the gas diffusion electrode, an elastic cushion material (cushion material) is packed in a cathode chamber, and the liquid retention layer is pressed uniformly against the entire surface of an anode along with the gas diffusion electrode via the ion exchange membrane by applying the pressure of the cushion material larger than that of the depth of anode liquid (1~15 kPa). Alternatively, the liquid retention layer may be formed integrally on the surface of the gas diffusion electrode at the time of the production of the gas diffusion electrode or may be formed integrally on the surface of the ion exchange membrane facing the cathode at the time of the production of the ion exchange membrane: Thereby, the liquid retention layer may be placed at a given position, coming into contact with the gas diffusion electrode and the ion exchange membrane. The term "integrally" herein used may be defined as that the function of the liquid retention layer is added to both the ion exchange membrane and the gas diffusion electrode by such a method that the liquid retention layer is bonded on the surface of the ion exchange membrane facing the cathode or on the surface of the gas diffusion electrode.

A method of integration is not specifically limited, but is exemplified by a method of melting each of the bonding surfaces of the liquid retention layer, the ion exchange membrane and the gas diffusion electrode by, for example, a solvent to bond each other, or by a method of bonding them by, for example, a press, or by a method of sewing them together by a thread having the chemical and physical resistance against sodium hydroxide like the liquid retention layer.

Examples of bonding threads include a carbon, zirconium oxide, or a ceramics of silicon carbide, etc., resins such as hydrophilic-treated PTFE (polytetrafluoroethylene), FEP (tetrafluoroethylene-propylene hexafluoride copolymer), etc. aramid resin (general term for aromatic polyamides), metals such as nickel, silver, etc and alloys thereof or stainless steel, etc. When the liquid retention layer is integrated with the gas diffusion electrode, the place or position to be bonded is not specifically limited, but it may be bonded to the periphery of the gas diffusion electrode, etc. When the liquid retention layer is integrated with the ion exchange membrane, it may be bonded preferably to the part outside the electrolysis area practically used for electrolysis, more specifically, to the part of a gasket in which the ion exchange membrane is interposed. When the liquid retention layer is bonded to the part of the electrolysis area, there are possibilities that the performance of the ion exchange membrane is degraded.

As the ion exchange membrane used in this invention may be preferable an ion exchange membrane made of fluoroplastics-family resin for its corrosion resistance.

For the concentration of each of brine at the anode chamber outlet and the aqueous solution of sodium hydroxide at the outlet of the cathode chamber, it is preferable to select such an ion exchange membrane that a proper range of concentration can be obtained even in a case of two-chamber method. Specifically, it is preferable, as afore-mentioned above, to select such an ion exchange membrane that when an operation is carried out in the concentration of brine at the anode chamber outlet ranging from 190 to 230 g-NaCl/L, an aqueous solution of sodium hydroxide having the concentration from 30.0 to 34.0% by weight can be obtained. However, when a generally-used ion exchange membrane is used, the concentration of the aqueous solution of sodium hydroxide discharged from the cathode chamber is determined by the amount of the penetrating water from the anode chamber; when an operation is carried out in the above-described concentration of brine at the anode chamber outlet, the concentration of the aqueous solution of sodium hydroxide becomes from 36.5 to 40.0% by weight. However, at the present, such an ion exchange membrane that satisfies the above-described concentration characteristics of solution is not developed. It is, therefore, preferable to select such an ion exchange membrane that an aqueous solution of sodium hydroxide having the concentration ranging from 30.0 to 35.0% by weight can be obtained when an operation is carried out in the concentration of brine at the outlet of the anode chamber ranging from 120 to 190 g-NaCl/L. And, it is, further, preferable to select such an ion exchange membrane that an aqueous solution of sodium hydroxide having the concentration ranging from 33.0 to 35.0% by weight can be obtained when an operation is carried out in the concentration of brine at the outlet of the anode chamber ranging from 150 to 190 g-NaCl/L.

From the view point of the prevention of the accumulation of calcium, it has been known that there are large differences in the amount of the accumulation of calcium by lowering the concentration of aqueous solution of sodium hydroxide. It is, therefore, preferable that an operation is carried out in such concentration of brine at the anode chamber outlet that an aqueous solution of sodium hydroxide having lower concentration of 25.0% by weight or more and 33.0% by weight or less can be obtained. By carrying out the operation in such ranges as described above, it is made possible to prevent calcium from being deposited, and an efficient operation is made possible at a current efficiency of 95.0% or more. When the concentration of the aqueous solution of sodium hydroxide is less than 25% by weight, it is made possible to prevent calcium from being deposited; however, there are problems that the current efficiency is less than 95.0%, the amount of brine transferred from the anode chamber to the cathode chamber increases, the concentration of salt in the aqueous solution of sodium hydroxide increases, and reverse diffusion of the aqueous solution of sodium hydroxide into the anode chamber occurs. There are possibilities that titanium-material of anode chamber or anode-corrodes. So, that is extremely non-efficient operation.

As an anode may be preferably used an insoluble electrode made of titanium usually called DSA, but not limited thereto.

As a gas diffusion electrode may be preferably used a liquid penetrating-type gas diffusion electrode formed by attaching a reaction layer comprising Ag particles and PTFE particles to a carbon cloth-made electrode supporting member, or a liquid non-penetrating-type gas diffusion electrode formed by attaching a gas diffusion layer comprising a hydrophobic carbon and PTFE and a reaction layer comprising Ag particles, hydrophobic carbon, hydrophilic carbon and PTFE to a nickel-porous substrate, but not limited thereto.

Figure 6:
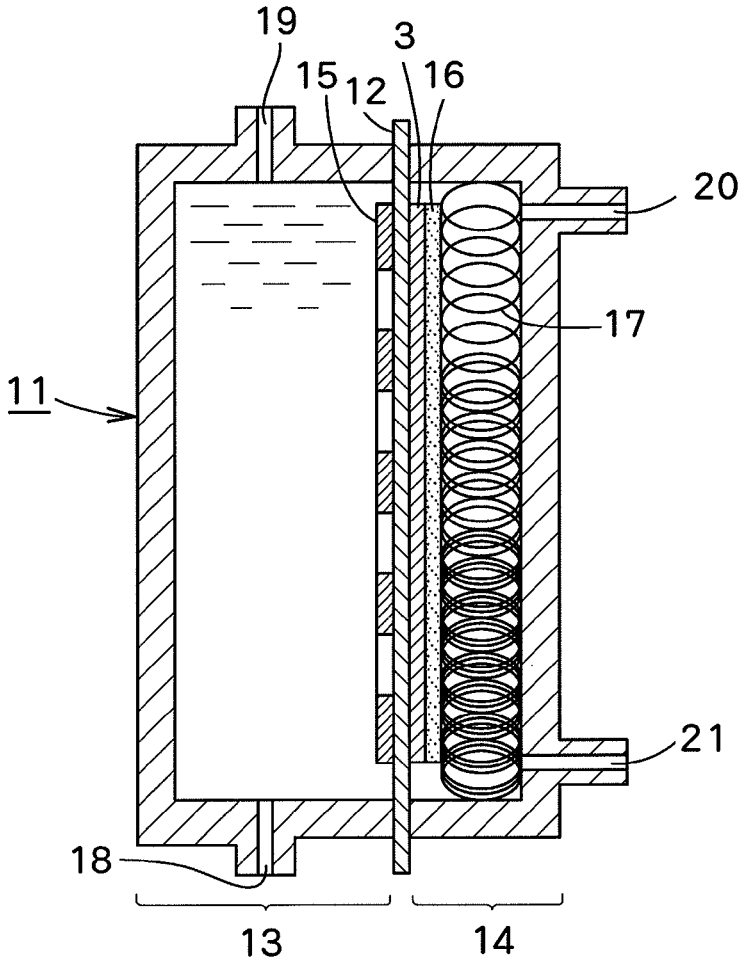
FIG. 6 is a longitudinal section of an example of an electrolytic cell for brine using a liquid retention layer of this invention.

FIG. 6 is a cross sectional view showing an example of an electrolytic cell for brine using a liquid retention layer shown in FIGS. 1 and 2.

The electrolytic cell main body 11 is divided into the anode chamber 13 and the cathode chamber 14 by the ion exchange membrane 12; the mesh-like anode 15 is in close contact with the surface of the ion exchange membrane 12 facing the anode chamber 13; the liquid retention layer 3 is in close contact with the surface of the ion exchange membrane 12 facing the cathode chamber 14; the gas diffusion electrode 16 is in close contact with the surface of the liquid retention layer 3 facing the cathode chamber 14; and the cushion material 17 is placed between the gas diffusion electrode 16 and a back plate of the electrolytic cell main body 11, that is, in the cathode chamber 14. A direct current is discharged ultimately from the cushion material 17.

A numeral 18 denotes an anode liquid (brine) introducing-inlet mounted in the vicinity of the bottom of the anode chamber 13; a numeral 19 denotes an anode liquid (unreacted brine) and chlorine gas discharging-outlet mounted in the upper wall of the anode chamber 13; a numeral 20 denotes an (moistened) oxygen-containing gas introducing-inlet mounted to the side wall in the vicinity of the upper part of the cathode chamber 14; and a numeral 21 denotes an aqueous solution of sodium hydroxide and excess oxygen-discharging outlet mounted in the side wall in the vicinity of the bottom of the cathode chamber 14.

Electric current is applied between the electrodes 15 and 16 with the brine supplied into the anode chamber 13 of the electrolytic cell main body 11 and with moistened oxygen-containing gas, for example, pure oxygen or air supplied into the cathode chamber 14 of the electrolytic cell main body 11.

The brine should be purified strictly. A calcium ion or magnesium ion, etc. should be removed from the brine by the use of chelate resin so that they exist in below 10 ppb. It is more preferable to lower the concentration of calcium ion to approximately 0.5 ppb by repeating the contact of the brine with the chelate resin. In this two-chamber oxygen cathode method, a cathode liquid flows scarcely and, therefore, a hydroxide deposits easily on the surface of the ion exchange membrane. Accordingly, particular attention should be paid. When the concentration of calcium ion is maintained at approximately 0.5 ppb, it is substantially possible to prevent the deposition of calcium.

It is preferable to moisten the oxygen-containing gas supplied, if necessary. As a method of moistening may be used a method of moistening by spraying the oxygen-containing gas supplied into an electrolytic cell with water, or by blowing the oxygen-containing gas in water, etc.

Sodium hydroxide is dissolved in penetrating-water penetrated through the ion exchange membrane from an anode chamber between the ion exchange membrane and the cathode to form a sodium hydroxide aqueous solution. A calcium ion in the penetrating-water diffuses into the liquid retention layer 3 on the surface of the ion exchange membrane 12 to deposit hardly on the surface of the ion exchange membrane 12.

The aqueous solution of sodium hydroxide thus formed diffuses inside the liquid retention layer 3, falls down by, specifically, the gravitation force to reach the lower end of the liquid retention layer 3, flows down to the bottom of the cathode chamber 14 as droplets, and discharged from the sodium hydroxide aqueous solution-and-excess oxygen-discharging outlet 21 together with excess oxygen-containing gas.

As conditions of electrolysis of the electrolytic cell, current density may be preferably from 1 to 10 kA/m$^2$; temperatures of each of the anode chamber and the cathode chamber at the time of electrolysis are not specifically limited, but may be those usually used, and it is preferable to set the range of temperature corresponding to the current density in order to exhibit the performance of the ion exchange membrane to the maximum. The temperature ranges are slightly different depending on the types of the ion exchange membranes, but, for example, when the current density is 1.0 kA/m$^2$ or more and less than 2.0 kA/m$^2$, it may be preferably 68~82° C.; when the current density is 2.0 kA/m$^2$ or more and less than 3.0 kA/m$^2$, it may be preferably 77~85° C.; and when the current density is 3.0 kA/m$^2$ or more, it may be preferably 80~90° C.

EXAMPLES

Next, Examples of electrolysis making use of the electrolytic cell in accordance with this invention will be described. However, this invention shall be deemed to be restricted thereto.

In the following Examples, the electrolytic voltage is defined as a value obtained by measuring the voltage between a cathode frame and an anode frame by a voltmeter ("DIGITAL MULTMETER 753704" manufactured by Yokogawa Electric Corporation; trade name), and the current efficiency is defined as the ratio of the actual amount of the production of sodium hydroxide to the theoretical amount of the production of sodium hydroxide corresponding to quantity of electricity used for electrolysis.

The accumulation amount of calcium inside the ion exchange membrane was calculated in such a manner as described below:

The ion exchange membrane mounted to the electrolytic cell was removed; a reaction surface was cut to 10 mm in width, 10 mm in height; all of the ion exchange membranes thus cut was immersed in 1.0 mol/L hydrochloric acid having a temperature of 60° C. for 16 hours; the composition of the hydrochloric acid was analyzed by an inductively coupled plasma-optical emission spectrometry ("SPS 1500" manufactured by Seiko Instruments Inc.: trade name; hereinafter referred to as "ICP"); then, the weight of calcium element was calculated by the concentration of calcium element in hydrochloric acid obtained and amount of liquid of hydrochloric acid; and then the accumulation amount per unit area was calculated by dividing the weight thus obtained by the reaction surface size of the ion exchange membrane.

Example 1

A dimensionally stable electrode manufactured by Permelec Electrode Ltd. was used as an anode and a liquid penetration-type gas diffusion electrode manufactured by Permelec Electrode Ltd. was used as a cathode. Each of the reaction surfaces of the anode and the gas diffusion electrode was 100 mm in width and 100 mm in height, respectively.

"AciplexF-4403D" manufactured by Asahi Kasei Chemicals Corporation (trade name) was used as an ion exchange membrane. The reaction surface of the ion exchange membrane was 100 mm in width and 100 mm in height. A liquid retention layer installed between the ion exchange membrane and the gas diffusion electrode was PFA-made formed article having a thickness A of 0.2 mm and a liquid-retention amount per unit volume of 0.26 g-$H_2O/cm^3$. An electrolytic cell was assembled by putting the liquid retention layer between the ion exchange membrane and the gas diffusion electrode, and bringing the anode into contact with the ion exchange membrane.

Brine having a concentration of 300 g-NaCl/L was supplied to an anode chamber as an anode liquid, then 1.5 times required theoretical amount of moistened oxygen gas were supplied to the cathode chamber in 160 mL/minutes. While controlling the flow rate of the anode liquid so that the concentration of sodium hydroxide aqueous solution discharged from the cathode chamber was 34.5% by weight, electrolysis was carried out at a temperature of 88° C. and at an electric current of 30.0 A. 34.5% by weight sodium hydroxide were obtained from the cathode chamber outlet at an electrolytic voltage of 2.00V and at a current efficiency of 97.0%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 14 $mg/m^2$. An experiment was continued in the same manner as described above. At a $400^{th}$ day from the beginning of the experiment, the electrolytic voltage was 2.01V and the current efficiency was 96.8%; the electrolytic voltage rose by 10 mV and the current efficiency lowered by 0.2%, respectively.

Example 2

Electrolysis was carried out in the same conditions as those of Example 1, except that the amount of brine supplied to the anode chamber was controlled so that the concentration of sodium hydroxide aqueous solution discharged from the cathode chamber in Example 1, that is, 34.5% by weight was 33.0% by weight. Initial electrolytic voltage was 1.99V and current efficiency was 96.8%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 3 $mg/m^2$ (Reference should be made to Example 1 in which it was 14 $mg/m^2$).

Example 3

Electrolysis was carried out in the same conditions as those of Example 1, except that the amount of brine supplied to the anode chamber was controlled so that the concentration of sodium hydroxide aqueous solution discharged from the cathode chamber in Example 1, that is, 34.5% by weight was 25.0% by weight.

Initial electrolytic voltage was 1.99V and current efficiency was 95.2%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 3 $mg/m^2$ (Reference should be made to Example 1 in which it was 14 $mg/m^2$).

Example 4

Electrolysis was carried out in the same conditions as those of Example 1, except that a PFA-made formed article having a thickness A of 0.2 mm and a liquid-retention amount per unit volume of 0.26 g-$H_2O/cm^3$ was used as a liquid retention layer installed between the ion exchange membrane and the gas diffusion electrode; and such a liquid retention layer as described above was sewn to the periphery of the ion exchange membrane with a PTFE-made thread having a diameter of 0.3 mm to integrate together. 34.5% by weight sodium hydroxide were obtained from the cathode chamber outlet at an electrolytic voltage of 2.00V and at a current efficiency of 97.0%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 14 $mg/m^2$. An experiment was continued in the same manner as those of Example 1. At a $400^{th}$ day from the beginning of the experiment, the electrolytic voltage was 2.01V and the current efficiency was 96.8%; the electrolytic voltage rose by 10 mV and the current efficiency lowered by 0.2%, respectively.

Example 5

Electrolysis was carried out in the same conditions as those of Example 1, except that an aramid resin-made twill woven-textile having a thickness A of 0.46 mm and a liquid-retention amount per unit volume of 0.37 g-$H_2O/cm^3$ was used as a liquid retention layer installed between the ion exchange membrane and the gas diffusion electrode. 34.5% by weight sodium hydroxide were obtained from the cathode chamber outlet at an electrolytic voltage of 2.00V and at a current efficiency of 97.0%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 23 $mg/m^2$. An experiment was continued in the same manner as those of Example 3. At a $400^{th}$ day from the beginning of the experiment, the electrolytic voltage was 2.02V and the current efficiency was 96.7%; the electrolytic voltage rose by 20 mV and the current efficiency lowered by 0.3%, respectively.

Example 6

Electrolysis was carried out in the same conditions as those of Example 1, except that an aramid resin-made twill woven-textile having a thickness A of 0.46 mm and a liquid-retention amount per unit volume of 0.37 g-$H_2O/cm^3$ was used as a liquid retention layer installed between the ion exchange membrane and the gas diffusion electrode; and such a liquid retention layer as described above was sewn to the periphery of the gas diffusion electrode with an aramid resin-made thread having a diameter of 0.3 mm to integrate together.

34.5% by weight sodium hydroxide were obtained from the cathode chamber outlet at an electrolytic voltage of 2.00V and at a current efficiency of 97.0%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 23 $mg/m^2$. An experiment was continued in the same manner as those of Example 3. At a 400th day from the beginning of the experiment, the electrolytic voltage was 2.02V and the current efficiency was 96.7%; the electrolytic voltage by 20 mV and the current efficiency lowered by 0.3%, respectively.

Example 7

Electrolysis was carried out in the same conditions as those of Example 1, except that a graphitized carbon-made plain woven-textile having a thickness A of 0.45 mm and a liquid-retention amount per unit volume of 0.24 g-$H_2O/cm^3$ was used as a liquid retention layer installed between the ion exchange membrane and the gas diffusion electrode.

34.5% by weight sodium hydroxide were obtained from the cathode chamber outlet at an electrolytic voltage of 2.00V and at a current efficiency of 97.0%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 95 $mg/m^2$. An experiment was continued in the same manner as those of Example 1. At a $400^{th}$ day from the beginning of the experiment, the electrolytic voltage was 2.03V and the current efficiency was 96.7%; the electrolytic voltage rose by 30 mV and the current efficiency lowered by 0.3%, respectively.

Examples 8~15

Each of eight types of textiles having materials, thicknesses and liquid-retention amounts per unit volume shown in Table 1 and made in manners of weaving shown in Table 1 was used as a liquid retention layer. And, electrolyses were carried out in the same conditions as those of Example 1 (Examples 8~15). Liquid-retention amounts per unit volume in each of Examples 8~15 were 0.34, 0.43, 0.54, 0.61, 0.16, 0.19, 0.54 and 0.53 g-$H_2O/cm^3$ in the order of Examples 8~15 and were in the range from 0.15 to 0.61 g-$H_2O/cm^3$.

For each of Examples 8~15, the calcium concentration in the ion exchange membrane at a $30^{th}$ day from the beginning of the operation was measured by ICP analysis, and confirmed that accumulation were 23, 53, 90, 170, 198, 182, 145 and 102 $mg/m^2$ in the order of Examples 8~15 and were 200 $mg/m^2$ or less.

Examples 16~20

Each of five types of textiles having materials, thicknesses and liquid-retention amounts per unit volume shown in Table 1 and made in manners of weaving shown in Table 1 was used as a liquid retention layer. And, electrolyses were carried out in the same conditions as those of Example 1 (Examples 16~20. Liquid-retention amounts per unit volume in each of Examples 16~20 were 0.14, 0.10, 0.68, 0.12 and 0.80 g-$H_2O/cm^3$ in the order of Examples 16~20 and were in the range from 0.10 to 0.80 g-$H_2O/cm^3$.

For each of Examples 16~20, the calcium concentration in the ion exchange membrane at a $30^{th}$ day from the beginning of the operation was measured by ICP analysis, and confirmed that accumulation were 453, 531, 312, 506 and 512 $mg/m^2$ in the order of Examples 16~20 and were 550 $mg/m^2$ or less.

Comparative Example 1

Electrolysis was carried out in the same conditions as those of Example 1, except that a graphitized carbon-made plain woven-textile having a thickness A of 4.92 mm and a liquid-retention amount per unit volume of 0.95 g-$H_2O/cm^3$ was used as a liquid retention layer installed between the ion exchange membrane and the gas diffusion electrode.

34.5% by weight sodium hydroxide were obtained from the cathode chamber outlet at an electrolytic voltage of 2.06V and at a current efficiency of 97.0%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 862 $mg/m^2$. An experiment was continued in the same manner as those of Example 1. At a $400^{th}$ day from the beginning of the experiment, the electrolytic voltage was 2.15V and the current efficiency was 96.0%; the electrolytic voltage rose by 90 mV and the current efficiency lowered by 1.0%.

Comparative Example 2

Electrolysis was carried out in the same conditions as those of Example 1, except that a thin plate-like liquid retention layer having no unevenness on its surface facing the ion exchange membrane and having a liquid-retention amount per unit volume of 0.06 g-$H_2O/cm^3$ was used.

34.5% by weight sodium hydroxide were obtained from the cathode chamber outlet at an electrolytic voltage of 2.00V and at a current efficiency of 97.0%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 848 $mg/m^2$. An experiment was continued in the same manner as those of Example 1. At a $400^{th}$ day from the beginning of the experiment, the electrolytic voltage was 2.09V and the current efficiency was 96.0%; the electrolytic voltage rose by 90 mV and the current efficiency lowered by 1.0%, respectively.

Comparative Example 3

Electrolysis was carried out in the same conditions as those of Example 1, except that no liquid retention layer was used between the ion exchange membrane and the gas diffusion electrode. 34.5% by weight sodium hydroxide were obtained from the cathode chamber outlet at an electrolytic voltage of 2.04V and at a current efficiency of 96.5%. No change was observed in the electrolytic voltage and the current efficiency at a $30^{th}$ day from the beginning of the operation. The calcium concentration in the ion exchange membrane at a $30^{th}$ day from the beginning of the operation was measured by ICP analysis, and confirmed that accumulation was 848 $mg/m^2$. An experiment was continued in the same manner as those described above. At a $400^{th}$ day from the beginning of the experiment, the electrolytic voltage was 2.13V and the current efficiency was 95.5%; the electrolytic voltage rose by 90 mV and the current efficiency lowered by 1.0%, respectively.

Figure 7:
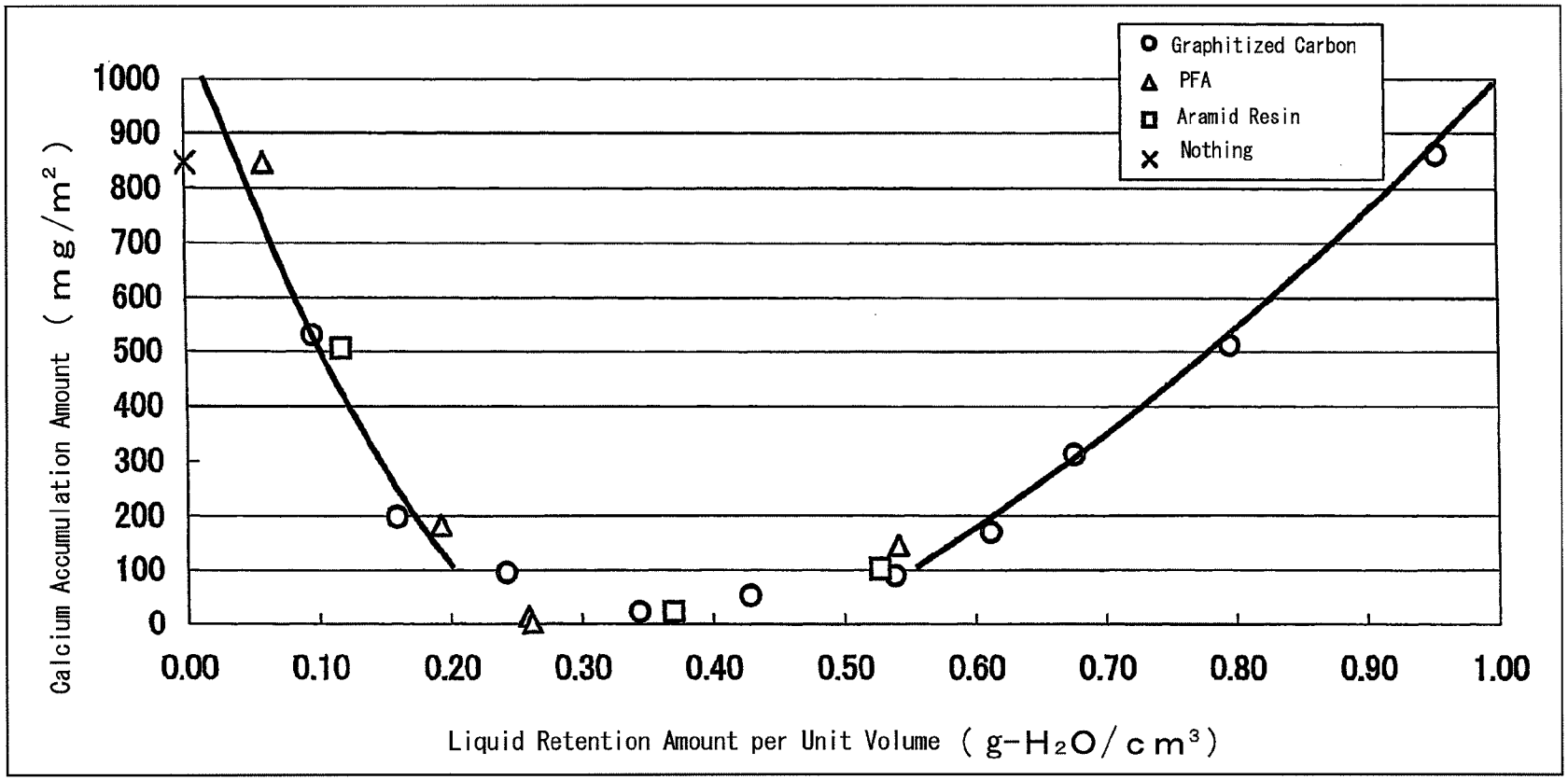
FIG. 7 is a graph showing the relationship between the liquid retention amount of the liquid retention layer per unit volume and the amount of calcium in the ion exchange membrane, in each of Examples and Comparative Examples.

Results obtained by Examples 1~20 and Comparative Examples 1~3 were summarized in Table-1, and relationship between the liquid-retention amount per unit volume of the liquid retention layer (g-$H_2O/cm^3$) and the calcium amount in the ion exchange membrane in each of Examples and Comparative Examples was summarized in the graph shown in FIG. 7.

From the graph shown in FIG. 7, it is evident that by maintaining the liquid-retention amount in the range from 0.10 g-$H_2O/cm^3$ to 0.80 g-$H_2O/cm^3$, the calcium amount accumulated in the ion exchange membrane can be suppressed to 550 $mg/m^2$ or less, and an efficient operation is made possible in which the drop in the current efficiency is suppressed by more than 1.4 times compared with the case where the liquid-retention amount is 0.06 g-$H_2O/cm^3$ or 0.95 g-$H_2O/cm^3$.

TABLE 1

| Example and Comparative Example | Material | Manner of weaving | Integration with membrane or electrode | Concentration of sodium hydroxide (wt %) | Thickness (mm) | Liquid-retention amount per unit volume (g-$H_2O$/$cm^3$) | Accumulation amount of calcium per unit area of ion exchange membrane (μg/$m^2$) |
|---|---|---|---|---|---|---|---|
| Example 1 | PFA | Formed article | No | 34.5 | 0.20 | 0.26 | 14 |
| Example 2 | PFA | Formed article | No | 33.0 | 0.20 | 0.26 | 3 |
| Example 3 | PFA | Formed article | No | 25.0 | 0.20 | 0.26 | 3 |
| Example 4 | PFA | Formed article | Yes | 34.5 | 0.20 | 0.26 | 14 |
| Example 5 | Aramid resin | Twill weave | No | " | 0.46 | 0.37 | 23 |
| Example 6 | Aramid resin | Twill weave | Yes | " | 0.46 | 0.37 | 23 |
| Example 7 | Graphitized carbon | Plain weave | No | " | 0.45 | 0.24 | 95 |
| Example 8 | Graphitized carbon | Plain weave | No | " | 0.60 | 0.34 | 23 |
| Example 9 | Graphitized carbon | Twill weave | No | " | 1.00 | 0.43 | 53 |
| Example 10 | Graphitized carbon | Satin weave | No | " | 1.20 | 0.54 | 90 |
| Example 11 | Graphitized carbon | Satin weave | No | " | 1.50 | 0.61 | 170 |
| Example 12 | Graphitized carbon | Plain weave | No | " | 0.82 | 0.16 | 198 |
| Example 13 | PFA | Plain weave | No | " | 1.00 | 0.19 | 182 |
| Example 14 | PFA | Formed article | No | " | 0.20 | 0.54 | 145 |
| Example 15 | Aramid resin | Twill weave | No | " | 0.46 | 0.53 | 102 |
| Example 16 | Graphitized carbon | Twill weave | No | " | 0.30 | 0.14 | 453 |
| Example 17 | Graphitized carbon | Plain weave | No | " | 0.30 | 0.10 | 531 |
| Example 18 | Graphitized carbon | Plain weave | No | " | 0.11 | 0.68 | 312 |
| Example 19 | Aramid resin | Twill weave | No | " | 0.80 | 0.12 | 506 |
| Example 20 | Graphitized carbon | Plain weave | No | " | 4.10 | 0.80 | 512 |
| Comparative Example 1 | Graphitized carbon | Plain weave | No | " | 4.92 | 0.95 | 862 |
| Comparative Example 2 | PFA | Formed article (thin sheet) | No | " | 0.60 | 0.06 | 848 |
| Comparative Example 3 | No | No | No | " | 0.00 | 0.00 | 848 |

| Example and Comparative Example | Initial electrolytic voltage (V) | Increase in voltage after elapse of 400 days (mV) | Initial current efficiency (%) | Drop in current efficiency after elapse of 400 days (%) |
|---|---|---|---|---|
| Example 1 | 2.00 | 10 | 97.0 | 0.2 |
| Example 2 | 1.99 | 0 | 96.8 | 0 |
| Example 3 | 1.99 | 0 | 95.2 | 0 |
| Example 4 | 2.00 | 10 | 97 | 0.2 |
| Example 5 | 2.00 | 20 | 97.0 | 0.3 |
| Example 6 | 2.00 | 20 | 97.0 | 0.3 |
| Example 7 | 2.00 | 30 | 97.0 | 0.3 |
| Example 8 | 2.00 | 10 | 97.0 | 0.2 |
| Example 9 | 2.01 | 10 | 97.0 | 0.2 |
| Example 10 | 2.01 | 30 | 97.0 | 0.3 |
| Example 11 | 2.02 | 40 | 97.0 | 0.4 |
| Example 12 | 2.01 | 40 | 97.0 | 0.4 |
| Example 13 | 2.01 | 40 | 97.0 | 0.4 |
| Example 14 | 1.99 | 30 | 97.0 | 0.3 |
| Example 15 | 2.00 | 30 | 97.0 | 0.3 |
| Example 16 | 2.00 | 50 | 97.0 | 0.5 |
| Example 17 | 2.00 | 70 | 97.0 | 0.7 |
| Example 18 | 1.99 | 50 | 97.0 | 0.5 |
| Example 19 | 2.01 | 70 | 97.0 | 0.6 |
| Example 20 | 2.05 | 70 | 97.0 | 0.6 |
| Comparative Example 1 | 2.06 | 90 | 97.0 | 1 |
| Comparative Example 2 | 2.00 | 90 | 97.0 | 1 |
| Comparative Example 3 | 2.04 | 90 | 96.5 | 1 |

The invention claimed is:

1. A method of producing sodium hydroxide and chlorine using an electrolytic cell which is divided into an anode chamber and a cathode chamber by an ion-exchange membrane such that said cell operates as a two-chamber cell, said method comprising forming an electrolytic cell comprising an anode installed in said anode chamber, and a liquid retention layer and a gas diffusion electrode installed in said cathode chamber, said liquid retention layer having a structure selected from the group consisting of a mesh, a plain weave, a woven fabric, a nonwoven article, a foam, a thin sheet in which one side thereof has a plurality of concavities, and a thin sheet having a plurality of penetrations therethrough, the structure being formed of a material selected from the group consisting of perfluoroalkoxy alkane (PFA) resin and aramid resin, conducting an electrolysis reaction within said cell wherein brine is supplied into said anode chamber and an oxygen-containing gas is supplied into said cathode chamber, respectively; and placing said liquid retention layer, having a liquid retention amount per unit volume of the liquid retention layer of 0.15 g-$H_2O$/cm3 or more and 0.61 g-$H_2O$/cm3 or less, between said ion-exchange membrane and said gas diffusion electrode.

2. The method as claimed in claim 1, wherein said liquid retention amount is 0.25 g-$H_2O/cm^3$ or more and 0.40-$H_2O/cm^3$ or less.

3. The method as claimed in claim 1, wherein said liquid retention layer is integrated with said ion exchange membrane or said gas diffusion electrode.

4. The method as claimed in claim 1, wherein said liquid retention layer is made of a material having a chemical and physical resistance against sodium hydroxide.

5. The method as claimed in claim 1, wherein an aqueous solution of sodium hydroxide is discharged from said cathode chamber, said aqueous solution of sodium hydroxide having a concentration of 33.0% by weight or more and 35.0% by weight or less.

* * * * *